United States Patent [19]

Ackerman

[11] Patent Number: 4,498,828

[45] Date of Patent: Feb. 12, 1985

[54] SAMPLE BOOK AND METHOD OF MAKING SAME

[75] Inventor: Don Ackerman, Scotch Plains, N.J.

[73] Assignee: Economy Color Card Co., Inc., Roselle, N.J.

[21] Appl. No.: 543,791

[22] Filed: Oct. 21, 1983

Related U.S. Application Data

[63] Continuation of Ser. No. 318,203, Nov. 4, 1981, abandoned.

[51] Int. Cl.[3] ..... B42D 1/00; B42D 1/04; B42D 3/00

[52] U.S. Cl. ..... 412/4; 412/19; 281/21 R; 281/29

[58] Field of Search ..... 412/4, 19; 281/21 R, 281/29

[56] References Cited

U.S. PATENT DOCUMENTS

| | | | |
|---|---|---|---|
| 1,466,618 | 8/1923 | Fry | 281/21 R |
| 2,120,819 | 6/1938 | Steinthal | 281/21 R X |
| 3,330,718 | 7/1967 | James, Jr. et al. | 281/21 R |
| 3,912,304 | 10/1975 | Abildgaard et al. | 281/21 R |
| 3,973,787 | 8/1976 | Staats et al. | 281/21 R |
| 4,129,471 | 12/1978 | Rome | 281/21 R X |
| 4,289,330 | 9/1981 | Wiermanski | 281/29 |

FOREIGN PATENT DOCUMENTS

| | | | |
|---|---|---|---|
| 2075915 | 11/1981 | United Kingdom | 281/29 |

OTHER PUBLICATIONS

Watson, Donald R., Xerox Disclosure Journal, vol. 2, No. 1, Jan./Feb., 1977.

*Primary Examiner*—Paul A. Bell
*Assistant Examiner*—Taylor J. Ross
*Attorney, Agent, or Firm*—Lerner, David, Littenberg, Krumholz & Mentlik

[57] ABSTRACT

A sample book for wall covering samples, decorative fabrics and the like is disclosed. The sample book comprises a cover member which includes first and second substantially planar cover sections hingedly joined to a substantially planar spine section, a plurality of individual sample sheets arranged in a stack, and a pair of tear-resistant holding strips disposed along one edge and on opposite sides of the stack of sample sheets. The stack of sample sheets are bound together between the holding strips by means of staples or the like to form an edge portion defined by the edges of the sample sheets between the holding strips. The edge portion is adhesively secured to the spine section of the cover member to form the sample book. In this manner, a sturdy sample book is provided in which the first and second cover sections may each be hingedly opened to lie in substantially the same plane as the planar spine section to facilitate easy and substantially full viewing of the sample sheets.

37 Claims, 6 Drawing Figures

SAMPLE BOOK AND METHOD OF MAKING SAME

This is a continuation of application Ser. No. 318,203 filed Nov. 4, 1981, now abandoned.

FIELD OF THE INVENTION

The present invention relates to sample books for wall covering samples, decorative fabric samples and the like, and to a method of making same. More particularly, the present invention is directed to a sample book which is of a rugged and sturdy construction so as to be capable of withstanding much abuse by customers and others, while at the same time allowing the front and back covers to be opened substantially flat to permit easy and substantially full viewing of the sample sheets therein, thereby minimizing the amount of waste (i.e., non-viewable area) required for binding of the sample sheets in the sample book.

BACKGROUND OF THE INVENTION

Sample books are used in the wall covering and other industries for binding together into a single book a multitude of different samples of material, such as for example wallpaper, decorative fabrics and other wall coverings and decorative materials. For instance, sample books may be used by customers for the examination, viewing, and selection of wall coverings for purchase. As is well known, such sample books are generally quite bulky and often are very heavy as they must collect and bind together in a single book a large number of different samples or materials. Further, such sample books are generally subjected to much abuse and misuse by customers who simply tend to flip through and toss aside and/or drop the books. Still further, littlecare is taken by the store owners or operators of establishments in which the books are used. Consequently, such sample books must be quite rugged and sturdy so as to be capable of withstanding such abuse and mistreatment by customers and others. In particular, it is most important that the sample sheets be firmly held and bound in the book, and that the overall sample book itself maintain its integrity so as to provide a relatively long life despite the generally destructive and damaging environment in which it is used.

In this regard, because of the extensive abuse and mistreatment to which sample books are generally subjected, conventional techniques for binding sheets of paper in books cannot be used for the binding of the sample sheets in a sample book. More particularly, the binding of sheets of paper in books generally involves providing a plurality of groups of folded sheets of paper in a stack, the sheets in each group being sewn or stitched together, and the groups being glued along one edge to a cloth or other backing material to hold the sheets together. Thereafter, the stack of bound sheets is secured in the book by simply gluing the first and last sheets of the stack directly to the inner surface of the front and back covers of the book. Thus, it will be appreciated that in conventional books, the groups of paper are only held together by means of the adhesive between the edges of the group and a cloth or other backing member, and the bound sheets are only secured or held to the cover by a pair of sheets of paper.

Such a technique for binding would be inadequate for sample books as the manner of binding the sheets together and the manner of securing the bound sheets to the cover would not generally be capable of withstanding the extensive abuse and mistreatment experienced by sample books. For instance, individual sample sheets generally are not folded and thus would not provide a sufficient gluing area for securement to a backing material. Thus, the individual sample sheets could be easily pulled away from the backing material. This would be particularly true with respect to sample sheets made of cloth. Further, the technique of securing the bound sheets to the cover only by means of the first and last sheets of the bound stack would not provide a strong means of securement and would most likely break or be destroyed after much use, particularly in an environment in which the books are subjected to much abuse and mistreatment.

One known type of conventional sample book provides of a pair of relatively wide holding strips on the upper and lower surfaces of a stack of sample sheets for binding and holding therebetween a stack of sample sheets. More particularly, the holding strips are arranged along one edge of the stack, and the sample sheets and holding strips are stapled together or secured with other suitable fasteners. In many instances, a number of intermediate holding strips are also provided within the stack along the one edge. Generally, these holding strips may comprise a strip of cardboard having a substantial thickness in comparison to the sample sheets and a significant width, on the order of 1" to 1½", so as to firmly hold and bind one edge of the sample sheets together. Thereafter, the bound stack of sample sheets are mounted within a cover member having a U-shaped spine or backbone using nails or pins which are driven through the legs of the spine (generally referred to as nailing strips) into and through the holding strips and sample sheets. The cover member includes hinged cover sections which are hingedly joined to the ends of the U-shaped spine. Such a means of binding the sample sheets within a cover member has proven to be generally adequate in terms of ruggedness and sturdiness since the sample sheets are firmly held between the holding strips by the staples and by the nails passing through the nailing strips of the spine of the cover member.

However, this technique of binding sample sheets in book form is also subject to a number of disadvantages. Most important in this regard is the fact that a significant amount of sample material is unusable and cannot be viewed, i.e., the portion of each sample sheet which is held and nailed between the legs of the spine section is unusable by the customer. Thus, a significant amount of additional material is required in order to bind the sample sheets in the sample book. This serves to increase the cost of the sample material, which additional cost can be very significant when it is considered that each sheet must include the additional material. Also, significantly larger size books must be provided in order to provide a desired viewing area or portion of the material from which the customer may select a particular wall covering or decorative fabric. This also serves to increase the cost of the sample book and can be quite significant, particularly when many thousands of sample books must be provided for numerous retail establishments. Still further, since the spine of this prior art type sample book is U-shaped, the location at which the front and rear covers are hinged is displaced from the base of the spine, i.e., the hinge joints are located at the ends of the legs of the spine. Thus, the front and rear covers will not lie substantially flat or in the same plane as the base of the spine during use. Accordingly, when customers view the samples, they are continuously having to hold down the covers while they are flipping through the various sample sheets.

In another known sample book, which attempts to overcome some of the disadvantages noted above, the plurality of sample sheets are bound together using a generally U-shaped, thin cardboard or paper backing between the legs of which the sample sheets are glued, i.e., along the edges of the sample sheets. Also the legs of the U-shaped backing are adhesively secured to the upper and lower sheets of the stack. The bound sample sheets are then adhesively secured within a cover member which also includes a generally U-shaped spine section, the base and sides of the U-shaped backing being adhesively secured to respective portions of the spine section. Thus, the front and back cover sections of the cover member are hinged to the spine section at a location displaced from the base of the spine section so that the sample book again is subject to the same disadvantages noted above with respect to more conventional sample books. In other words, a significant area of each sample sheet is wasted and cannot be viewed, and the front and rear covers cannot be opened to lie substantially in the same plane as the base of the spine section of the sample book. Further, while the amount of wasted material is less than in conventional sample books using nails and nailing strips, i.e., on the order of $\frac{7}{8}''$, such sample books have generally not proven completely satisfactory from the standpoint of being capable of withstanding extensive abuse and mistreatment. For example, the covers have been found to break or rip away from the bound sample sheets.

Thus, the search has continued for an improved sample book which overcomes the above-noted and other disadvantages of the prior art, and in particular which will provide for minimization of the amount of excess material which is required, while at the same time being capable of withstanding the generally rigorous and abusive conditions to which sample books are generally subjected.

SUMMARY OF THE INVENTION

In accordance with the present invention, there is provided a sample book for sample sheets which comprises a cover member including first and second substantially planar cover sections hingedly joined to a substantially planar spine section, a plurality of individual sample sheets arranged in a stack, and a pair of tear-resistant holding strips provided on opposite sides of the stack of sample sheets and disposed along one edge thereof. Holding strip securing means are provided for securing the pair of holding strips together to bind the plurality of sample sheets therebetween to form a bound stack of sample sheets having an edge portion defined by the edges of the sample sheets between the holding strips. Adhesive securing means are provided for adhesively securing only the edge portion of the bound stack of sample sheets to the spine section of the cover member to form the sample book. Because the spine section is substantially planar, the first and second cover sections of the sample book may thus each be hingedly opened to lie in substantially the same plane as the planar spine section to permit substantially full viewing of the sample sheets.

Such a sample book provides for a rugged, sturdy construction for binding of the sample sheets within the cover member so as to be capable of withstanding the rigorous and abusive conditions to which such sample books are normally subjected by customers and others. At the same time, the sample book in accordance with the present invention permits the utilization of substantially the entire area of the sample sheets, without a significant portion being required for the binding of the sample sheets within the book. This consequently minimizes the amount of wasted material, and consequently a significant cost savings for the relatively expensive sample sheets can be realized.

In accordance with a preferred embodiment of the present invention, tear-resistant covering sheets, of a width less than the width of the sample sheets, are provided on the top and bottom of the stack of sample sheets and bound between the holding strips. The covering sheets are folded back over the holding strips and secured in a suitable manner to the inside surfaces of the first and second cover sections, thereby hiding the holding strips and providing a more aesthetically pleasing appearance. Also, a liner sheet may be adhesively secured to the inside surface of the first and second cover sections to overlie the folded back tear-resistant covering sheets to complete or finish the aesthetically pleasing appearance for the sample book. Here it should be noted that the tear-resistant covering sheets also provide an additional means for securing the bound stack of sample sheets within the cover member.

In accordance with a further aspect of the present invention, there is provided a method of making a sample book for sample sheets which is comprised of the steps of providing a cover member which includes first and second substantially planar cover sections hingedly joined to a substantially planar spine section, providing a stack of sample sheets to be bound, securing the stack of sample sheets together between a pair of holding strips arranged along the opposite sides of the stack and disposed along one edge of the stack to thereby provide a bound stack of sample sheets having an edge portion defined by the edges of the sample sheets between the holding strips, and then adhesively securing only the edge portion of the bound stack of sample sheets to the spine section of the cover member. In this manner, the first and second cover sections of the sample book may each be hingedly opened to lie in substantially the same plane as the planar spine section to permit substantially full viewing of the sample sheets bound therein.

These and further features and characteristics of the present invention will be apparent from the following detailed description in which reference is made to the enclosed drawings which illustrate a preferred embodiment of the present invention.

DETAILED DESCRIPTION OF PREFERRED EMBODIMENT

Figure 1:
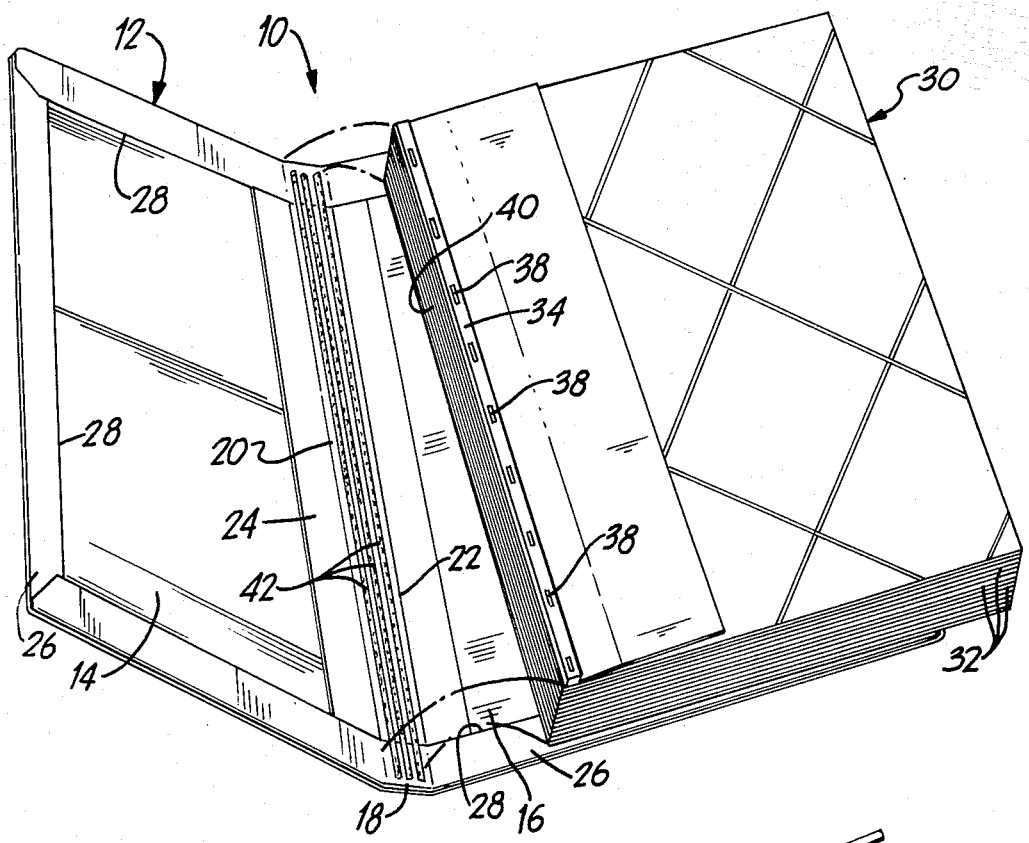
FIG. 1 is an exploded perspective view of a sample book for wall covering samples in accordance with the present invention, illustrating a bound stack of sample sheets for being adhesively secured to a cover member.

Referring now to the drawings wherein like references characters represent like elements, there is illustrated in FIG. 1 the basic components of the sample book 10 in accordance with the present invention. More particularly, the sample book 10 includes a cover member 12 having substantially planar first and second cover sections 14, 16 joined together by means of a substantially planar spine section 18. The first and second cover sections 14, 16 are each hingedly connected to the spine section 18 along hinge lines 20 and 22. In this manner, the first and second cover sections 14, 16 will form the top and bottom covers respectively of the finished sample book 10, and the spine section 18 will form the back covered edge of the sample book 10.

Figure 3:
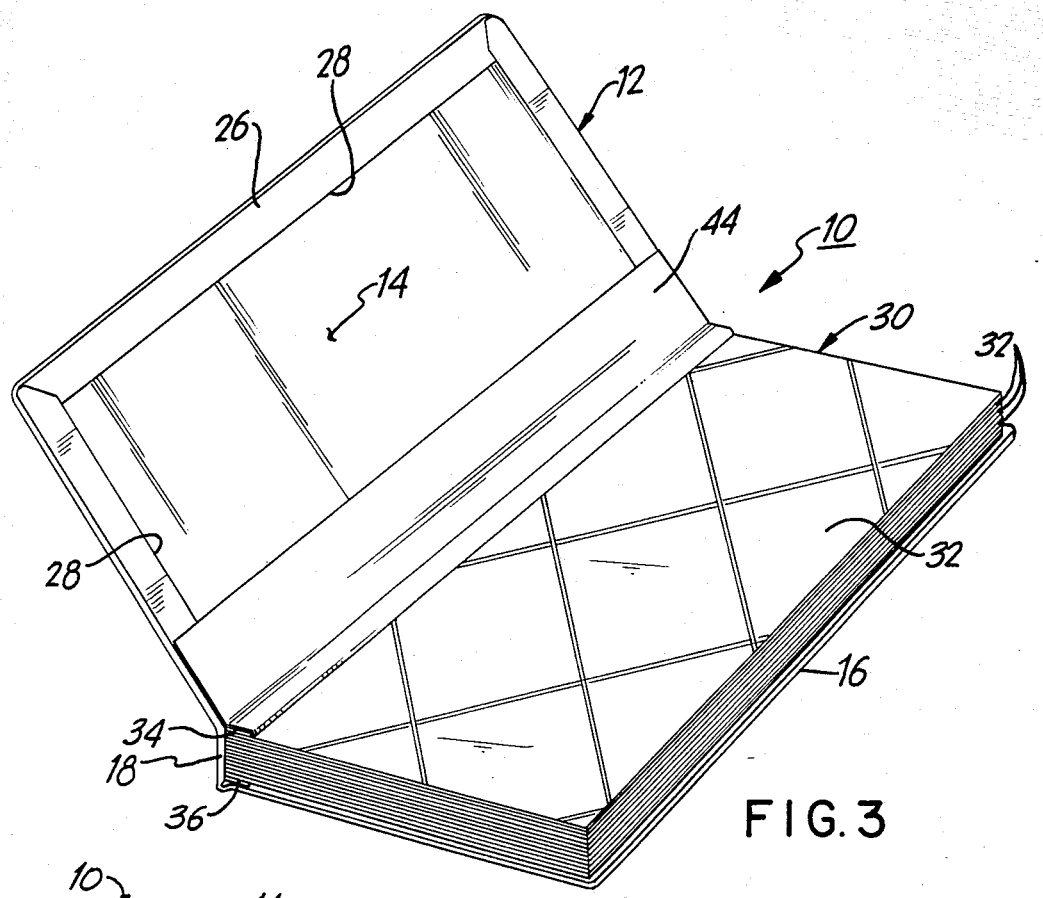
FIG. 3 is the perspective view illustrating how tear-resistant covering sheets are folded back over the holding strips and secured to the inside surface of the cover member in accordance with the present invention.
Figure 4:
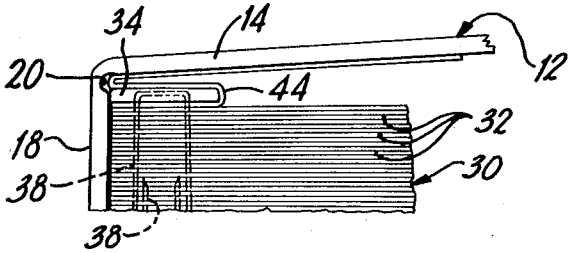
FIG. 4 is an enlarged end sectional view showing how the tear-resistant covering sheets are secured in place.

The cover member 12 is constructed of any suitable material, such as for example cardboard as is conventional, which will provide a sturdy backing for the sample book 10 and in particular a backing capable of withstanding mistreatment and abuse. In the preferred embodiment, each of the first and second cover sections 14, 16 and the spine section 18 comprises a separate piece of cardboard, the three pieces of cardboard being joined together by a suitable reinforcing covering material (e.g., reinforcing sheet material 24 in FIG. 1) to form the two hinge joints or lines 20,22. That is, the hinge joints 20,22 are formed by the spaces between the cardboard sections so that the first and second cover sections 14, 16 may be easily folded or hinged relative to the spine section 18. Also in the preferred embodiment, the outer surface of the cover member 12, i.e., the surface which will form the outer face of the finished sample book 10, has a continuous decorative cover sheet 26 adhesively secured thereto, the edges 28 of the sheet 26 being folded inwardly over the edges of the cardboard material to terminate on the inner surface of the cover member 12, as best seen in FIGS. 1, 3 and 4. Such a construction for the cover member 12 in which the hinge lines or connections 20, 22 between the first and second cover sections 14, 16 and the spine section 18 are formed by spaces between separate cardboard sections is basically conventional. Alternatively, the hinge lines 20, 22 could be formed by portions of reduced thickness in a continuous sheet of cardboard material, as is also known in the art.

However, there is one important difference between the cover member 12 of the present invention and the cover members of prior art sample books. This difference is that the spine section 18 in accordance with the present invention is substantially planar, as are the first and second cover sections 14, 16, and that the hinge joints or lines 20, 22 are located so that the cover member 12 may be opened to lie substantially flat. That is, the cover sections 14, 16 are hinged along lines 20, 22 which lie in the plane of the spine section 18 so that the cover sections 14, 16 may each be opened or hinged to lie in the same plane as the spine section 18. This for instance can be most clearly seen in FIG. 6 which illustrates an end view of the finished sample book 10 and which shows the first and second cover sections 14, 16 opened to lie in the same plane as the spine section 18. Such a cover member 12 is in direct contrast to cover members of the prior art which have U-shaped spine sections and in which the front and back covers do not open flat.

Figure 2:
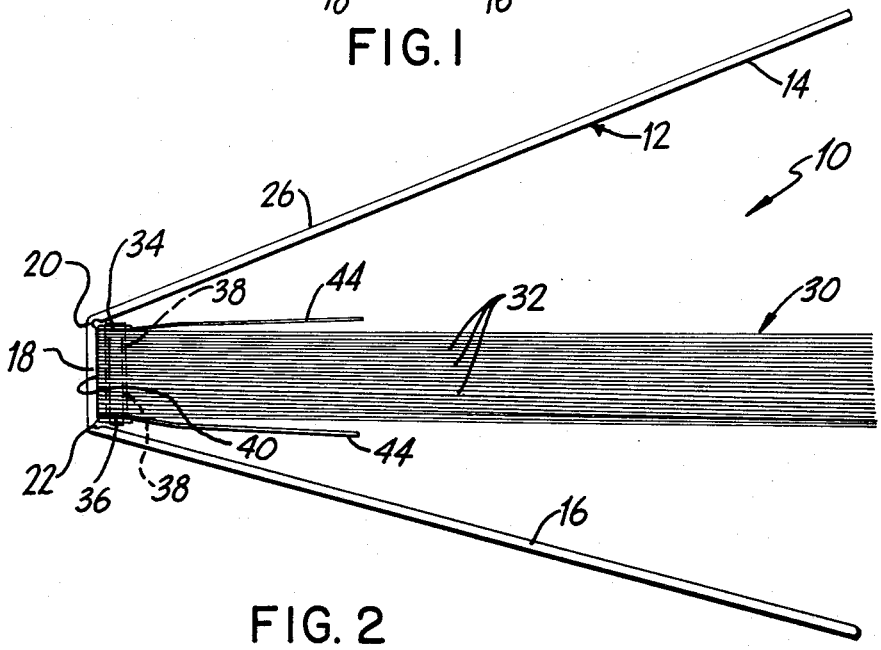
FIG. 2 is an end view of the sample book in accordance with the present invention illustrating how the bound stack of sample sheets are adhesively secured to the spine section of the cover member.

The second basic component of the sample book 10 of the present invention comprises a bound stack 30 of sample sheets 32 which are to be secured to the cover member 12. The sample sheets 32, which may comprise sheets of wallpaper or other wall coverings, or sheets of decorative fabrics or other materials, are arranged in a stack and bound together along one edge. In accordance with the present invention, this binding of the sample sheets 32 is accomplished by utilizing a pair of holding strips 34, 36 arranged on opposite sides of the stack 30 of sample sheets 32 along the edge to be bound and the provision of suitable means 38 for tightly holding or clamping the holding strips 34, 36 together to bind the edges of the sample sheets 32 therebetween, as best seen in FIGS. 1 and 2. More particularly, the holding strips 34, 36 are made of a tear-resistant material, such as for example plastic, cardboard or the like, which are capable of holding staples or other suitable securing means 38. In the preferred embodiment, plastic holding strips 34, 36 are provided along one edge and on opposite sides of the stack 30 of sample sheets 32 and are then stapled together by passing staples 38 through each of the holding strips 34, 36 along the length thereof. That is, staples 38 are passed through the holding strips 34, 36 on each side of the stack 30 of sample sheets 32 into and through the sample sheets 32 along one edge. Preferably, the staples 38 pass almost completely through the stack 30 of sample sheets 32, but do not protude through the opposite holding strip 34 or 36. The staples 38 thus serve to provide a firm, sturdy binding or holding of the sample sheets 32 between the holding strips 34, 36 so that the sheets 32 may not easily be pulled out from between the holding strips 34, 36. In this regard, the staples 38 and holding strips 34, 36 provide a much more firm securement than would otherwise be provided by a glue or other similar adhesive. Of course, other types of fasteners could be utilized if desired, such as for example rivets, pins, etc.

The bound stack 30 of sample sheets 32 thus has an edge portion or surface 40 defined by the edges of the sample sheets 32. After the sample sheets 32 are bound together, the edge surface 40 is adhesively secured with a suitable adhesive to the inner surface of the spine section 18 of the cover member 12 (see FIG. 2). In this regard, while any suitable adhesive may be utilized, it is preferred to use a hot melt adhesive which does not require a long cure time. For instance, the hot melt adhesive may be applied to the spine section 18 in a series of rows 42 (see FIG. 1), and the edge surface 40 of the bound stack 30 of sample sheets 32 then firmly held thereagainst while the hot melt adhesive cures to provide a firm secure bond. The hot melt adhesive is also preferred as it will form a secure adhesive bond with vinyl wall coverings which are often incapable of being bonded with water-based adhesive.

Further in this regard, the width of the spine section 18 should correspond to the width or thickness of the bound stack 30 of sample sheets 32 so that the hinged first and second cover sections 14, 16 will lie flat against the upper and lower surfaces of the stacked sheets 32. Additionally, the first and second cover sections 14, 16 will be hinged substantially at the edge of the bound stack 30 of sample sheets 32 so that the cover sections 14, 16 when opened will lie in the same plane as the planar spine section 18 (see FIGS. 2 and 6). Such a sample book and method of assembly in which the sample sheets 32 are bound between a pair of tear-resistent holding members 34, 36 to hold the sample sheets in place and in which the bound stack 30 of sample sheets 32 are then firmly and securely bonded to the spine section 18 of the cover member 12, insures that the individual sample sheets 32 will not be easily torn or removed from the book 10, but instead, will be maintained in the sample book 10.

Preferably, after the sample sheets 32 are bound between the holding strips 34, 36, the edge thereof is trimmed in any suitable manner, such as for example, by cutting with a saw, in order to provide an even surface 40 for adhesive securement to the cover member 12. In this regard, it is also preferable that the edge portion 40 of the bound stack 30 of sample sheets 32 be roughened slightly in order to provide a suitable surface for receiving and providing a firm secure bond for the adhesive.

Here it should be noted that the width of the holding strips 34, 36 in accordance with the present invention is relatively small, on the order of $\frac{1}{8}''$–$\frac{1}{4}''$, particularly in comparison to conventional nailing strips provided in the prior art which generally have a width on the order of $1$–$1\frac{1}{2}''$. This is required in prior art sample books for the purposes of receiving nails and nailing the cover member to the bound sample sheets. Because a different means of securing the bound stack 30 of sample sheets 32 to the cover member 12 is utilized in accordance with the present invention, the substantial width strips provided in the prior art are not necessary. Here it should also be noted that the provision of the holding strips 34, 36 being of a narrow width is most important in order to minimize the amount of unused or wasted material for the sheets 32 in the finished sample book 10. With narrow holding strips 34, 36 as provided in accordance with the present invention, virtually the entire sample sheet 32 may be used for viewing by customers. At the same time, however, because of the holding strips 34, 36 and the manner of securing the bound stack 30 of sheets 32 to the cover member, a rugged, sturdy sample book 10 will be provided which is capable of withstanding the abuse to which sample books are generally subjected.

Further in accordance with the preferred embodiment of the present invention, there is provided a pair of covering sheets 44 which are bound with the sample sheets 32 between the pair of holding strips 34, 36 (see FIG. 2). These covering sheets 44 are of a relatively narrow width in comparison to the sample sheets 32, and are provided on the top and bottom of the stack 30 of sample sheets 32 with one edge aligned with the edge of the sample sheets 32 to be bound together. Also, the covering sheets 44 are made of a tear-resistant material, such as for example, book cloth or a spun bonded polyolefin material such as is sold by du Pont under the tradename "Tyvek". Such a spun bonded polyolefin material has a very high tensile strength and will not easily tear.

The rear-resistant covering sheets 44 preferably have a pressure sensitive adhesive on the surface thereof facing away from the sample sheets 32 so that they may be adhesively secured to the inner surface of the first and second cover sections 14, 16 after the edge portion 40 of the bound stack 30 of sample sheets 32 has been adhesively secured to the spine section 18 of the cover member 12. More particularly, as best seen in FIGS. 3 and 4, the tear-resistant covering sheets 44 are folded back over the plastic holding strips 34, 36 and adhesively secured to the inner surface of the first and second cover sections 14, 16. This provides a means for covering and hiding the plastic holding strips 34, 36, and further serves to provide an additional adhesive bond for holding the bound stack 30 of sample sheets 32 in place within the cover member 12. Here it will be appreciated that because of the tear-resistant nature of the covering sheets 44, as well as the adhesive securement of the edge portion 40 of the bound stack 30 of sample sheets 32 to the spine section 18, a very rugged, sturdy bond is provided for the sample sheets 32 within the cover member 12 which will not easily be broken or destroyed during subsequent use of the sample book 10. It should also be noted that the provisions of the tear-resistant covering sheets 44 does not interfere with the hinge action of the first and second cover sheets 14, 16 with respect to the spine section 18.

Figure 5:
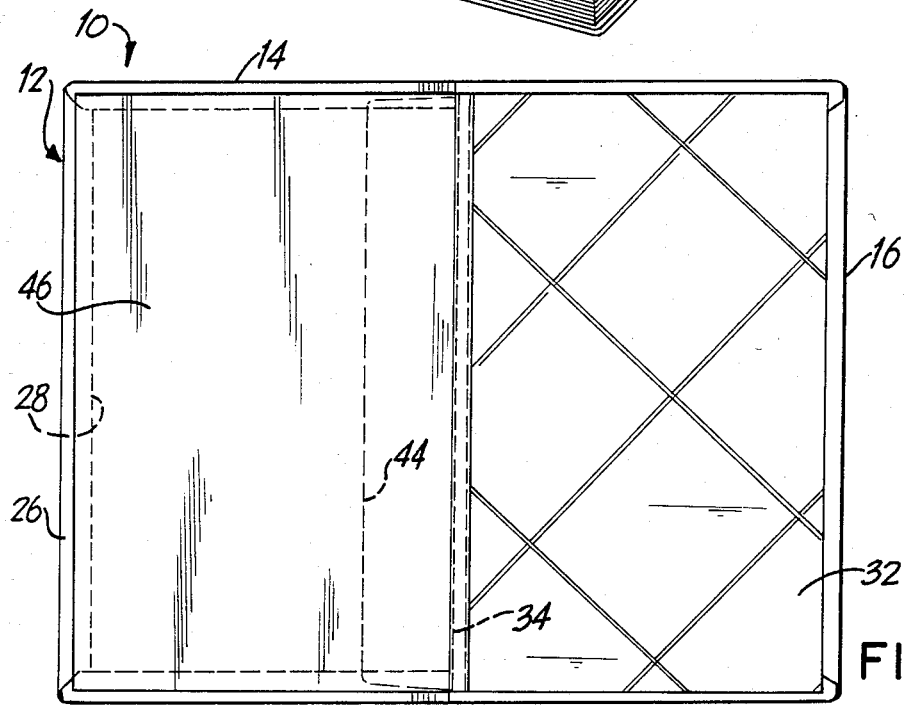
FIG. 5 is a top plan view of the finished sample book of the present invention with the front cover opened and illustrating a liner sheet secured to the inside surface of one cover section of the cover member.

In order to finish the sample book 10, preferably a suitable liner sheet 46 is adhesively bonded to the inside surfaces of the first and second cover section 14, 16, as best seen in FIG. 5, in order to cover the edge of the tear-resistant covering sheets 44 and provide a pleasing aesthetic appearance for the inside of the finished sample book 10. In this regard, the liner sheet 46, as is conventional, also covers the inner edges 28 of the decorative cover sheet 26 which had been folded back and secured to the inner surfaces of the cover member 12.

Figure 6:
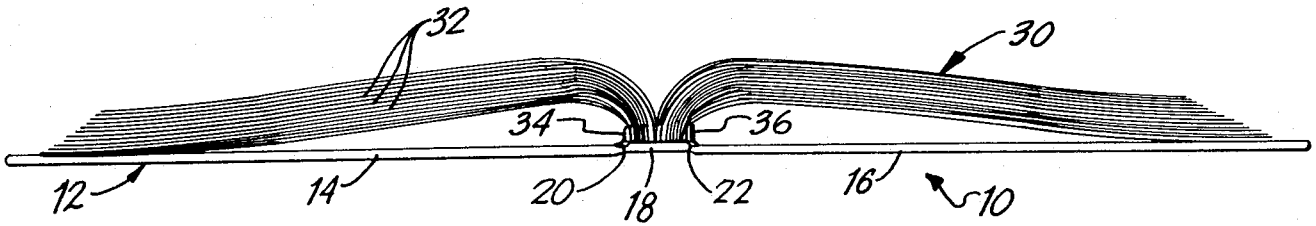
FIG. 6 is an end view of the finished sample book in accordance with the present invention when the sample book is opened, and illustrating the first and second cover sections lying in substantially the same plane as the spine section to thereby permit substantially full viewing of the sample sheets therewithin.

Thus, it will be appreciated that in accordance with the present invention, a sample book 10 is provided which is of a rugged, sturdy construction so as to be capable of withstanding the normal abuses to which sample books are subjected in retail establishments and the like, and yet at the same time minimizes the amount of wasted or unusable material for the sample sheets 32. Because of the narrow width of the holding strips 34, 36 and the fact that the sample sheets 32 are firmly bound together at a location very near or adjacent the edge of the sheets 32 (in the preferred embodiment on the order of $\frac{1}{8}$–$\frac{1}{4}''$), there is very little waste or unusable material. Further in this regard, as best seen in FIG. 6, when the sample book 10 is used, the front and rear covers (i.e., the first and second cover sections 14, 16) may both be opened to lie in substantially the same plane as the spine section 18 and thereby provide greater viewing access to the sample sheets 32. This is particularly important when it is considered that the costs of such sample sheets 32 is relatively expensive, especially when a multitude of sample books 10 each having a multitude of sample sheets 32 are to be made. In particular, the sample book 10 of the present invention may be made of a smaller size than prior art sample books and the overall size of the sample sheets 32 reduced, and yet still provide a desired size of viewing area for customers. For example, with prior art sample books of a size on the order of 18" high by 11" wide having a $1\frac{1}{4}''$ nailing strip, the viewing area would be approximately 175.5 square inches ($18'' \times 9\frac{3}{4}''$). On the other hand, with the present invention, it is possible to save approximately one inch in the width of each of the sample sheets 32, thereby conserving approximately 18 square inches or 10% of material for each sheet 32. As can be appreciated, when the number of sheets 32 is quite large for each sample book 10 and the number of sample books 10 to be made is quite large, this amount of savings can be quite significant.

Furthermore, since the sample books 10 may be opened substantially flat in accordance with the present invention, such as shown in FIG. 6, it is much easier for the customers to conduct an examination of the various samples within the books 10 since they are not constantly having to hold down the front or rear covers 14, 16 and the sheets 32 therein as they are flipping through the pages. This thus makes the examination, viewing and selection task much easier for customers. At the same time, the sample books 10 in accordance with the present invention are quite rugged and sturdy and thus capable of withstanding the types of abuses to which sample books are generally subjected. Still further, the sample books 10 themselves have a pleasing aesthetic appearance in that no unsightly nails are visible. Also, the aesthetics are enhanced by the fact that after a great amount of use, the sample books 10 still remain in good, solid, sturdy condition.

Therefore, it is seen that in accordance with the present invention, there is provided an improved sample book 10 for sample sheets 32 in which the sample book 10 comprises a cover member 12 having first and second substantially planar cover sections 14, 16 joined by a substantially planar spine section 18 in which the first and second cover sections 14, 16 are each hingedly connected to the spine section 18, and a plurality of individual sample sheets 32, arranged in a stack 30 for being bound to the cover member 12. A pair of tear-resistant holding strips 32, 34 are provided on opposite sides of the stack 30 of sample sheets 32 and disposed along one edge of the stack 30, and holding strip securing means 38 are provided for securing the pair of holding strips 34, 36 together to bind the plurality of sample sheets 32 therebetween to form a bound stack 30 of sample sheets 32 having an edge portion 40 defined by the edges of the sample sheets 32 between the holding strips 34, 36. The edge portion 40 of the bound stack 30 of sample sheets 32 is adhesively secured with adhesive securing means 42 to the spine section 18 of the cover member 12 to form the sample book 10 in which the first and second cover sections 14, 16 thereof may be hingedly opened to lie in substantially the same plane as the planar spine section 18 to permit substantially full viewing of the sample sheets 32.

There is also provided in accordance with the present invention a method of making a sample book 10, comprising the steps of providing a cover member 12 having first and second substantially planar cover sections 14, 16 hingedly joined to a substantially planar spine section 18 so that the first and second cover sections may each be hingedly opened to lie in substantially the same plane as the planar spine section 18. A plurality of individual sample sheets 32 are arranged in a stack 30 and bound together by means of a pair of holding strips 34, 36 provided on opposite sides of the stack 30 of sample pages 32 and disposed along one edge of sample sheets 32, the holding strips 34, 36 being secured by suitable holding means 38 to bind the plurality of sample sheets 32 therebetween to form an edge portion 40 defined by the edges of the sample sheets 32. The bound stack 30 of sample sheets 32 is then secured to the cover member 12 by adhesively securing only the edge portion 40 of the bound stack 30 of sheets 32 to the spine section 18 of the cover member 12 to form the sample book 10.

Further, in accordance with the preferred embodiment, the stack 30 of sample sheets 32 are provided with a pair of tear-resistant covering sheets 44 of a width less than the overall width of the sample sheets 32, the covering sheets being folded back over the holding strips 34, 36 and secured to the inside surface of the cover sections 14, 16. Also, a liner sheet 46 may then be provided to cover the entire inner surfaces of the first and second cover sections 14, 16 to provide an aesthetically pleasing interior surface for finished sample book 10.

While the preferred embodiment of the present invention has been shown and described, it will be understood that such is merely illustrative and that changes may be made without departing from the scope of the invention as claimed.

What is claimed is:

1. A sample book for sample sheets comprising:

a cover member including first and second substantially planar cover sections joined by a substantially planar sturdy spine section, said first and second cover sections each being connected to said spine section by hinge means and each including an inner surface and an outer surface;

a plurality of individual sample sheets arranged in a stack;

sheet securing means disposed adjacent to one edge of said stack of sample sheets securing said plurality of individual sample sheets together to form a bound stack of sample sheets having a substantially planar edge surface defined by the edges of said sample sheets;

a pair of covering sheets for the outer surfaces of said bound stack, each of said covering sheets including a first portion and a second portion separated by a fold line, said first portions of said covering sheets each being secured to said bound stack so that said fold line thereof is in alignment with the plane of said planar edge surface of said bound stack;

edge securing means for adhesively securing only said planar edge surface of said bound stack of sample sheets to said planar spine section of said cover member so that they are connected together in abutting planar relationship; and means for adhesively securing only said second portions of said covering sheets to said inner surfaces of said first and second cover sections, respectively, whereby said hinge means are substantially in alignment with the plane of said planar edge surface of said bound stack so that said first and second cover sections of said sample book may be hingedly opened to lie in substantially the same plane as said planar spine section to permit substantially full viewing of said sample sheets.

2. The sample book of claim 1 wherein said sheet securing means are disposed adjacent to but spaced from said one edge of said stack of sample sheets.

3. The sample book of claim 1 wherein said individual sample sheets comprise individual sheets of wallpaper.

4. The sample book of claim 1 wherein said individual sample sheets comprise individual sheets of fabric.

5. The sample book of claim 1 wherein said edge securing means secures said planar edge surface of said bound stack of sample sheets directly to said planar spine section of said cover member.

6. The sample book of claim 1 wherein said spine section and said cover sections each comprise a separate sturdy backing member, said sturdy backing members being joined together by reinforcing covering material so that said hinge means comprise portions of said reinforcing covering material between said separate sturdy backing members.

7. The sample book of claim 6 wherein said separate sturdy backing members comprise pieces of cardboard.

8. The sample book of claim 1 wherein said first portions of said covering sheets are secured to said bound stack by said sheet securing means.

9. The sample book of claim 8 wherein said sheet securing means comprises staples disposed along said one edge of said stack of sample sheets and passing through a substantial portion of said sample sheets.

10. The sample book of claim 8 wherein said edge securing means comprises a hot melt adhesive interposed between said edge surface of said bound stack of sample sheets and said spine section.

11. The sample book of claim 8 wherein said means for adhesively securing said second portions comprises a pressure sensitive adhesive on one surface of said covering sheets.

12. The sample book of claim 11, further including a liner sheet for said inner surfaces of each of said first and second cover sections, said liner sheets being adhesively secured to said inner surfaces of said first and second cover sections and overlying said second portions of said covering sheets.

13. The sample book of claim 1 wherein said sheet securing means comprises a pair of tear resistant holding strips on opposite sides of said stack of said sample sheets, said holding strips being disposed along said one edge of said stack of sample sheets, and holding strip securing means for securing said pair of holding strips together to bind said plurality of said sample sheets therebetween to form said bound stack of sample sheets.

14. The sample book of claim 13 wherein said holding strips are made of a plastic material.

15. The sample book of claim 13 wherein said holding strips are made of a cardboard material.

16. The sample book of claim 13 wherein said holding strip securing means comprises staples for each of said holding strips, said staples passing through said holding strips and through a substantial portion of said sample sheets to form said bound stack of sample sheets.

17. The sample book of claim 13 wherein said adhesive securing means comprise a hot melt adhesive interposed between said edge surface of said bound stack of sample sheets and said spine section.

18. The sample book of claim 13 wherein said first portions of said covering sheets are secured to said bound stack by said holding strips and said holding strip securing means.

19. The sample book of claim 18 wherein said covering sheets are made of a tear-resistant material.

20. The sample book of claim 18 wherein said covering sheets each have a pressure sensitive adhesive on the surface thereof facing away from said sample sheets.

21. The sample book of claim 20 wherein said covering sheets have a width less than the width of said sample sheets.

22. The sample book of claim 21 further including a liner sheet for said inner surfaces of each of said first and second cover sections, said liner sheets being adhesively secured to said inner surfaces of said first and second cover section and overlying a portion of said covering sheets.

23. A sample book for sample sheets comprising:

a cover member including first and second substantially planar cover sections joined by a substantially planar sturdy spine section, said first and second cover sections each being connected to said spine section by hinge means and each including an inner surface and an outer surface;

a plurality of individual sample sheets arranged in a stack;

sheet securing means disposed adjacent to one edge of said stack of sample sheets securing said plurality of individual sample sheets together to form a bound stack of sample sheets having a substantially planar edge surface defined by the edges of said sample sheets;

a pair of covering sheets for the outer surfaces of said bound stack, each of said covering sheets including a first portion and a second portion separated by a fold line, said first portions of said covering sheets each being secured to said bound stack so that said fold line thereof is in alignment with the plane of said planar edge surface of said bound stack;

edge securing means for adhesively securing only said planar edge surface of said bound stack of sample sheets directly to said planar spine section of said cover member; and means for adhesively securing only said second portions of said covering sheets to said inner surfaces of said first and second cover sections, respectively, whereby said hinge means are substantially in alignment with the plane of said planar edge surface of said bound stack so that said first and second cover sections of said sample book may be hingedly opened to lie in substantially the same plane as said planar spine section to permit substantially full viewing of said sample sheets.

24. A method of making a sample book for sample sheets comprising the steps of:

providing a cover member having first and second substantially planar cover sections joined to a substantially planar sturdy spine section by hinge means, said first and second cover sections each including an outer surface and an inner surface;

providing a plurality of sample sheets in a stack;

binding said plurality of sample sheets together with sheet securing means disposed adjacent to one edge of said stack of sample sheets to form a bound stack of sample sheets having a substantially planar edge surface defined by the edges of said sample sheets;

providing a pair of covering sheets for the outer surfaces of said bound stack of sample sheets, said covering sheets each including a first portion and a second portion separated by a fold line;

securing said first portions of said covering sheets to said bound stack of sample sheets so that said fold lines thereof are in alignment with the plane of said planar edge surface of said bound stack of sample sheets;

adhesively securing only said planar edge surface of said bound stack of sample sheets to said planar spine section of said cover member so that they are connected together in abutting planar relationship; and adhesively securing only said second portions of said covering sheets to said inner surfaces of said first and second cover sections, respectively, whereby said hinge means of said cover member are substantially in alignment with the plane of said planar edge surface of said bound stack so that said first and second cover sections may be hingedly opened to lie in substantially the same plane as said planar spine section to permit substantially full viewing of said sample sheets.

25. The method of claim 24 wherein said step of binding comprises binding said plurality of sample sheets together with sheet securing means disposed adjacent to but spaced from said one edge of said stack of sample sheets.

26. The method of claim 24 wherein said step of providing a cover member comprises providing a cover member in which said spine section and said cover sections each comprise separate sturdy backing members joined together by reinforcing covering material so that said hinge means comprise portions of said reinforcing covering material between said separate sturdy backing members.

27. The method of claim 24 wherein said step of adhesively securing comprises adhesively securing said planar edge surface of said bound stack of sample sheets directly to said planar spine section of said cover member.

28. The method of claim 24 wherein said step of securing said first sections to said covering sheets to said bound stack of sample sheets comprises securing said first sections of said covering sheets with said sheet securing means.

29. The method of claim 28 wherein said second portions of said covering sheets have a pressure sensitive adhesive on one surface thereof and wherein said step of adhesively securing said second portions of said covering sheets comprises pressing said covering sheets to said inner surfaces of said first and second cover sections respectively.

30. The method of claim 28 wherein said step of binding comprises passing staples through said first portions of said covering sheets and said sample sheets.

31. The method of claim 28 wherein said step of adhesively securing only said edge surface to said spine section comprises applying a hot melt adhesive to said spine section and pressing said edge surface of said bound stack of sample sheets against said spine section.

32. The method of claim 24 wherein said step of binding comprises arranging a pair of holding strips on opposite sides of said stack of sample sheets and adjacent to one edge of said stack of sample sheets, and securing said holding strips together to hold said sample sheets therebetween.

33. The method of claim 32 wherein said step of securing said first portions of said covering sheets comprises binding said first portions between said holding strips.

34. The method of claim 33 wherein said second portions of said covering sheets have a pressure sensitive adhesive on one surface thereof and wherein said step of adhesively securing said second portions of said covering sheets comprises pressing said second portions of said covering sheets to said inner surfaces of said first and second cover sections.

35. The method of claim 33 wherein said step of securing said holding strips comprises passing staples through each of said holding strips into said first portions of said covering sheets and said sample sheets.

36. The method of claim 35 wherein said step of adhesively securing said edge surface to said spine section comprises applying a hot melt adhesive to said spine section and pressing said edge surface of said bound stack of sample sheets against said spine section.

37. A method of making a sample book for sample sheets comprising the steps of:

providing a cover member having first and second substantially planar cover sections joined to a substantially planar sturdy section by hinge means, said first and second cover sections each including an outer surface and an inner surface;

providing a plurality of sample sheets in a stack;

binding said plurality of sample sheets together with sheet securing means disposed adjacent to one edge of said stack of sample sheets to form a bound stack of sample sheets having a substantially planar edge surface defined by the edges of said sample sheets;

providing a pair of covering sheets for the outer surfaces of said bound stack of sample sheets, said covering sheets each including a first portion and a second portion separated by a fold line;

securing said first portions of said covering sheets to said bound stack of sample sheets so that said fold lines thereof are in alignment with the plane of said planar edge surface of said bound stack of sample sheets;

adhesively securing only said planar edge surface of said bound stack of sample sheets directly to said planar spine section of said cover member; and adhesively securing only said second portions of said covering sheets to said inner surfaces of said first and second cover sections, respectively, whereby said hinge means of said cover member are substantially in alignment with the plane of said planar edge surface of said bound stack so that said first and second cover sections may be hingedly opened to lie in substantially the same plane as said planar spine section to permit substantially full viewing of said sample sheets.

* * * * *

UNITED STATES PATENT AND TRADEMARK OFFICE

CERTIFICATE OF CORRECTION

PATENT NO. : 4,498,828

DATED : February 12, 1985

INVENTOR(S) : Don Ackerman

It is certified that error appears in the above-identified patent and that said Letters Patent are hereby corrected as shown below:

Column 14, line 21, after "sturdy", insert --spine--.

Signed and Sealed this

*Eighteenth* Day of *June 1985*

[SEAL]

*Attest:*

DONALD J. QUIGG

*Attesting Officer* *Acting Commissioner of Patents and Trademarks*